United States Patent [19]

Ookawa

[11] Patent Number: 4,949,697

[45] Date of Patent: Aug. 21, 1990

[54] IGNITER FOR AN INTERNAL COMBUSTION ENGINE

[75] Inventor: Kiyoshi Ookawa, Himeji, Japan

[73] Assignee: Mitsubishi Denki kabushiki Kaisha, Tokyo, Japan

[21] Appl. No.: 418,040

[22] Filed: Oct. 6, 1989

[30] Foreign Application Priority Data

Oct. 7, 1988 [JP] Japan ..... 63-252034

[51] Int. Cl.[5] ..... F02P 3/05

[52] U.S. Cl. ..... 123/644; 123/643; 315/209 T

[58] Field of Search ..... 123/644, 643, 640; 315/209 T

[56] References Cited

U.S. PATENT DOCUMENTS 4,750,467 6/1988 Neuhalfen ..... 123/644
4,836,176 6/1989 Fujino et al. ..... 123/644

FOREIGN PATENT DOCUMENTS 60-209667 10/1985 Japan ..... 123/644
63-205460 8/1988 Japan .

*Primary Examiner*—Andrew M. Dolinar
*Attorney, Agent, or Firm*—Sughrue, Mion, Zinn, Macpeak and Seas

[57] ABSTRACT

An engine igniter for a multi-cylinder engine has a plurality of power transistors for controlling the currents of corresponding ignition coils. The emitters of the power transistors are connected in common to a current sensing resistor. A differential amplifier amplifies the difference between the voltage across the current sensing resistor and a reference voltage. A current mirror circuit having a plurality of output terminals is driven by the output of the differential amplifier. Base current control transistors which control the base currents of the power transistors are controlled by the outputs of the current mirror circuit.

1 Claim, 1 Drawing Sheet

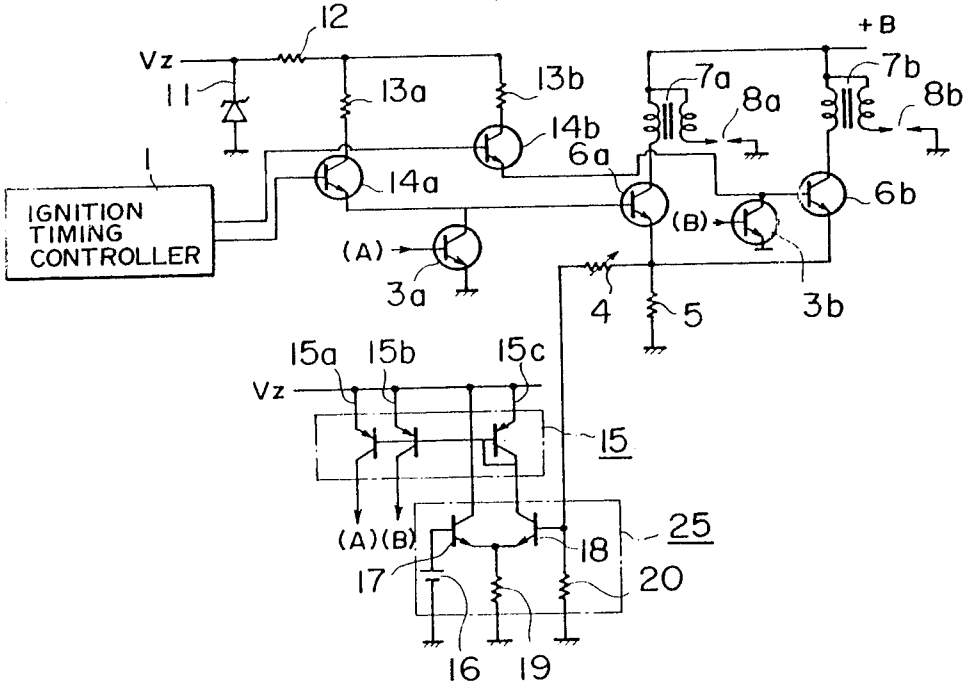
+B
7b
8b
6b
3b
8a
7a
(B)
5
4
25
20
15
18
19
16
17
(A)(B)
15c
15b
15a
Vz
13b
14b
6a
13a
14a
(A)
3a
12
11
Vz
1
IGNITION
TIMING
CONTROLLER

IGNITER FOR AN INTERNAL COMBUSTION ENGINE

BACKGROUND OF THE INVENTION

This invention relates to an igniter for an internal combustion engine. More particularly, it relates to an igniter having power transistors which are protected from excessive current.

An engine igniter is generally equipped with power transistors which control the current flowing through the primary winding of an ignition coil. As substantially all the primary winding current flows through the power transistors, it is necessary to protect the power transistors from damage due to excessive current. In a typical arrangement, a current sensing resistor is connected in series with each power transistor, and the base current of the power transistor is controlled by a base current control circuit in accordance with the voltage across the current sensing resistor. The base current control circuit generally includes a potentiometer for adjusting its operating characteristics.

The above-described arrangement has the disadvantage that it employs as many current sensing resistors and potentiometers as there are power transistors, so in an engine which has two or more cylinders, a large number of components is necessary. Furthermore, the current sensing resistors have a relatively large power consumption, so if they are in the form of thick-film components, they take up much space and increase the size of the igniter. In addition, it is necessary to initially adjust the potentiometer associated with each base current control circuit to a prescribed value. As there are a large number of potentiometers in the igniter, the adjusting process is time-consuming and costly.

SUMMARY OF THE INVENTION

It is an object of the present invention to provide an igniter for an internal combustion engine which employs a smaller number of current sensing resistors than a conventional igniter.

It is another object cf the present invention to provide an igniter for an internal combustion engine which has fewer parts requiring adjustment than a conventional igniter.

It is yet another object of the present invention to provide an igniter for an internal combustion engine which is compact.

An engine igniter according to the present invention has a plurality of power transistors. Each power transistor is associated with one cylinder of the engine and controls the primary current of a corresponding ignition coil. The emitters of the power transistors are connected in common to a current sensing resistor. A differential amplifier amplifies the difference between the voltage across the current sensing resistor and a reference voltage, and a current mirror circuit is driven by the output of the differential amplifier. The current mirror circuit has a plurality of output terminals, each of which is connected to a base current control transistor for one of the power transistors. In accordance with the voltage across the current sensing resistor, the base current control transistors are controlled so that the emitter currents of the power transistors are limited to prescribed, safe levels which will not damage the power transistors.

Since the power transistors conduct one at a time, a single current sensing resistor is adequate to sense the emitter currents of all the power transistors. Therefore, the number of current sensing resistors required by an igniter according to the present invention is much less than the number required by a conventional igniter.

BRIEF DESCRIPTION OF THE DRAWING

The sole figure is a circuit diagram of an embodiment of an engine igniter according to the present invention.

DESCRIPTION OF THE PREFERRED EMBODIMENT

A preferred embodiment of an engine igniter according to the present invention will now be described while referring to the accompanying drawing, which is a circuit diagram of this embodiment as applied to an unillustrated multi-cylinder engine. Each cylinder of the engine is equipped with an ignition coil and a spark plug. For the sake of simplicity, the ignition coils 7a and 7b and the spark plugs 8a and 8b for only two of the cylinders of the engine have been illustrated, but the other cylinders are similarly equipped. The spark plugs 8a and 8b are connected between one of the ends of the secondary windings of ignition coils 7a and 7b, respectively, and ground. One end of the primary winding of each ignition coil is connected to a battery voltage B+.

The ignition timing of the spark plugs 8a and 8b is controlled by a conventional ignition timing control circuit 1 which generates separate output signals for each spark plug. The output signals of the ignition timing control circuit 1 are provided to the bases of two transistors 14a and 14b, respectively. The collectors of transistors 14a and 14b are connected to a power supply Vz via a resistor 12 and resistors 13a and 13b, respectively. The emitters of transistors 14a and 14b are connected to the bases of two power transistors 6a and 6b for ignition coils 7a and 7b, respectively. The ignition timing control circuit 1 and the transistors 14a and 14b constitute a base current supply circuit for the power transistors 6a and 6b. The collectors of transistors 6a and 6b are connected to one end of the primary windings of ignition coils 7a and 7b, respectively, while their emitters are connected in common to one end of a current sensing resistor 5, the other end of which is grounded. A Zener diode 11 is connected between resistor 12 and ground.

The base currents of power transistors 6a and 6b are controlled by base current control transistors 3a and 3b, respectively. The collectors of transistors 3a and 3b are connected to the bases of power transistors 6a and 6b, respectively, while their emitters are grounded. Their bases are connected to the output terminals A and B, respectively, of a current mirror circuit 15.

A differential amplifier 25 has a pair of transistors 17 and 18 with their emitters connected in common to one end of a resistor 19, the other end of which is grounded. The base of transistor 17 is connected to a battery 16 which provides a reference voltage. The base of transistor 18 is connected to the junction of a potentiometer 4 and a resistor 20. The other end of the potentiometer 4 is connected to the emitters of power transistors 6a and 6b, and the other end of resistor 20 is grounded.

The current mirror circuit 15 comprises three transistors 15a–15c, the bases of which are connected in common. The emitters of all three transistors are connected to voltage Vz, as is the collector of transistor 17. The collector of transistor 15c is connected to its own base and to the collector of transistor 18. The collectors of the other two transistors 15*a* and 15*b* serve as output terminals A and B of the current mirror circuit 15 and are connected to the bases of transistors 3*a* and 3*b*, respectively.

The ignition timing control circuit 1 provides pulses to the bases of transistors 14*a* and 14*b* with a prescribed timing to switch these transistors on and off. When either of the transistors 14*a* or 14*b* is switched on, the corresponding power transistor 6*a* or 6*b* is switched on, and current flows through the primary winding of the corresponding ignition coil 7*a* or 7*b*. When transistor 14*a* or 14*b* is switched off again, the corresponding power transistor 6*a* or 6*b* is also switched off, a high voltage is generated in the secondary coil of the corresponding ignition coil 7*a* or 7*b*, and the corresponding spark plug 8*a* or 8*b* is ignited.

The emitter currents of the power transistors 6*a* and 6*b* also flow through the current sensing resistor 5. The collector voltage of transistor 18 of the amplifier 25 is proportional to the difference between the voltage across resistor 20, which is proportional to the current flowing through the current sensing resistor 5, and a reference voltage, i.e., the voltage of battery 16. The current mirror circuit 15 is driven by the collector voltage of transistor 18, and output terminals A and B provide currents which are proportional to the voltage difference which is amplified by the amplifier 25. The output currents of terminals A and B are supplied to the bases of transistors 3*a* and 3*b*, respectively, which control the base currents of transistors 6*a* and 6*b*. If the current flowing through the current sensing resistor 5 begins to increase above a prescribed level, transistors 3*a* and 3*b* act to decrease the base current of power transistors 6*a* and 6*b*, thereby decreasing the emitter currents of the power transistors 6*a* and 6*b* until the current flowing through the current sensing resistor 5 falls to the prescribed level. Therefore, the emitter currents of power transistors 6*a* and 6*b* can be limited to a prescribed, safe current which will not damage the power transistors 6*a* and 6*b*. The value of the prescribed current can be adjusted by means of the potentiometer 4.

The figure illustrates the components for controlling the operation of only two of the cylinders of the engine. However, the unillustrated ignition coils of each of the other cylinders are connected to the engine igniter 1, the differential amplifier 25, and the current mirror circuit 15 in the same manner as are ignition coils 7*a* and 7*b*. Therefore, if there are four cylinders in the engine, the current mirror circuit 15 will have four output terminals connected to corresponding base current control transistors 3*a*, 3*b*, etc.

It can be seen that a single current sensing resistor 5 and a single potentiometer 4 are shared by two or more ignition coils 7*a* and 7*b*, in contrast to a conventional igniter in which each ignition coil requires a separate current sensing resistor and potentiometer. Therefore, the present invention allows a decrease in the number of parts in an igniter, which is especially advantageous when the igniter is constituted by a monolithic IC. The decrease in the number of parts also enables a reduction in size, particularly when the current sensing resistors 5 are in the form of thick films. Furthermore, only a single potentiometer 4 needs to be adjusted for all the cylinders, so the amount of time required for adjusting the igniter is greatly reduced.

In the operation of the above-described embodiment, it is necessary that the power transistors 6*a* and 6*b* conduct at different times. However, a conventional ignition timing control circuit 1 can easily control the timing so as to prevent overlapping operation of the transistors 6*a* and 6*b* .

What is claimed is:

1. An engine igniter for an internal combustion engine comprising:

a plurality of power &transistors for controlling the primary currents of corresponding ignition coils of the engine, the emitters of the power transistors being connected in common;

a current sensing resistor which is connected to the emitters of the power transistors;

a differential amplifier which generates an output voltage proportional to the difference between the voltage across the current sensing resistor and a reference voltage;

a current mirror circuit having a plurality of output terminals which generate currents proportional to the output voltage of the differential amplifier;

a plurality of base current supply circuits for providing base current to each power transistor; and a plurality of base current control transistors, each of which is associated with one of the power transistors and has its collector connected to the base of the corresponding power transistor and its base connected to one of the output terminals of the current mirror circuit.

* * * * *